US006470599B1

(12) United States Patent
Chu

(10) Patent No.: US 6,470,599 B1
(45) Date of Patent: Oct. 29, 2002

(54) CLIMBING SHOE WITH CONCAVE SOLE

(76) Inventor: Young Chu, 9245 Sante Fe Springs Rd., Santa Fe Springs, CA (US) 90670

( * ) Notice: Subject to any disclaimer, the term of this patent is extended or adjusted under 35 U.S.C. 154(b) by 0 days.

(21) Appl. No.: 09/840,355

(22) Filed: Apr. 23, 2001

(51) Int. Cl.[7] ..... A43B 3/00; A43B 5/00; A43B 23/00; A43B 13/22; A43B 13/14

(52) U.S. Cl. ..... 36/113; 36/107; 36/114; 36/31; 36/76 C; 36/75 R

(58) Field of Search ..... 36/43, 88, 93, 36/102, 104, 107, 108, 113, 114, 30 R, 31, 44, 76 R, 76 C, 75 R

(56) References Cited

U.S. PATENT DOCUMENTS

| | | | | | |
|---|---|---|---|---|---|
| 2,114,461 | A | | 4/1938 | Agosta et al. | |
| 2,722,756 | A | | 11/1955 | Ecclesine | |
| D192,159 | S | | 2/1962 | Iorio | |
| 3,027,661 | A | | 4/1962 | McCord | |
| 3,494,055 | A | | 2/1970 | McSorley | |
| 4,259,792 | A | * | 4/1981 | Halberstadt | 36/30 R |
| D267,288 | S | | 12/1982 | Davis | |
| D267,366 | S | | 12/1982 | Davis | |
| 5,224,279 | A | * | 7/1993 | Agnew | 36/30 R |
| 5,595,004 | A | | 1/1997 | Lyden et al. | |
| 5,625,963 | A | * | 5/1997 | Miller et al. | 36/114 |
| 5,797,199 | A | * | 8/1998 | Miller et al. | 36/114 |
| 6,006,451 | A | * | 12/1999 | Morris et al. | 36/114 |
| 6,065,229 | A | * | 5/2000 | Wahrheit | 36/30 R |
| 6,195,918 | B1 | * | 3/2001 | Kelley et al. | 36/114 |
| 6,199,302 | B1 | * | 3/2001 | Kayano | 36/30 R |
| 6,226,900 | B1 | * | 5/2001 | Mazars | 36/114 |
| 6,295,742 | B1 | | 10/2001 | Bathum | |

OTHER PUBLICATIONS

World Footwear, vol. 15, No. 1, Jan./Feb. 2001: Front Cover Page and pp. 55 and 58.

* cited by examiner

*Primary Examiner*—Anthony D. Stashick
(74) *Attorney, Agent, or Firm*—John K. Park; Park & Sutton LLP

(57) ABSTRACT

A climbing shoe includes an inner sole, an outer sole and a molded middle sole between the inner sole and the outer sole. The middle sole is concave in shape. The outer sole conforms to the concave shape of the middle sole. The concave shape allows the outer sole to hook on a rocky ledge. The molded middle sole provides a structure that causes the concave outer sole to substantially maintain the concave shape when pressure is applied to the outer sole.

13 Claims, 4 Drawing Sheets

CLIMBING SHOE WITH CONCAVE SOLE

BACKGROUND

The invention relates to climbing shoes. More particularly, the climbing shoe with concave bottom shape relates to climbing shoes where the bottom surface of the shoe assists the climber in maintaining a firm foothold on the rocks.

Traditional climbing shoes have generally flat surfaces on the bottom of the climbing shoe. With a flat surface, the edges of the toe replaced on little foot holds on the rocks. Just the placement and pressure of the flat bottom surface of the shoe on the rocks assists in maintaining the foothold on the rocks. The climbing shoe needs great stability, since the whole weight of the individual may be supported by just the edges of the toe and the climber's hands. The climbing shoe must retain a solid hold on the rocks, when the climber stretches to reach the next foothold or hand old in the rocks. Climbing shoes with flat bottom surfaces can be prone to slipping and losing their grip on the rocks.

The prior art includes walking shoes that have a bottom outer sole with outside edges that protrude lower than the remaining inner portion of the bottom outer sole. The shape is designed to flex when walking to absorb some of the impact of the foot upon the walking surface. The curvature of the outer sole does not remain rigid, and the inner portion of the bottom outer sole flexes to touch the walking surface during walking. The edges are thicker than the other areas, so sensitivity is lost. The climber cannot adequately sense and feel the foot holds, when the edges are thick.

This walking shoe design is most disadvantageous for climbing. There is a need for a climbing shoes where the shape of the bottom outer sole is substantially maintained, so the climbing sole can hook on a rock. The hooking grip of the climbing shoe upon the small crevices can be lost if the bottom outer sole fails to remain rigidly in shape or when the climbing shoe bottom surface is flat, thus susceptible to slipping from the rocks. Very small projections in the rocks are used to hook the shoe of a climber. Just a small area of the bottom outer sole may be supporting the climber's weight when hooked on the rock. Walking shoes with curved outer soles are not designed to rigidly support the climber's weight, to the contrary, walking shoes are designed to flex to cushion the impact upon the foot.

In one prior art design, the sole tread pattern adapts to all types of ground due to its adjustable stud profile. As the foot presses down, the sole changes shape to grip the ground contours and on soft ground the studs penetrate the soil. As the weight is taken off the sole, it releases energy, giving wearers an added spring to their step. The changing shape of the sole is advantageous for walking, but can be detrimental in rock climbing. A sole that flexed and changed shape would be susceptible to losing a grip on a rocky ledge.

Therefore, there is a need for a climbing shoe with a bottom surface that is shaped for hooking the shoe on a rock ledge. Climbing shoes with flat surface are prone to sliding off of the rocks, when the climber stretches for a new hold and shifts his or her body weight. The new climbing shoe requires a shape that will provide greater traction and grip when climbing rocks than the traditional walking shoes or climbing shoes.

SUMMARY

A climbing shoe with a concave bottom shape fulfills the objective of a climbing shoe with a bottom surface that is shaped for hooking the shoe on a rock ledge. The climbing shoe with a concave sole provides greater traction and grip when climbing rocks, which provides greater safety and confidence for the climber.

A climbing shoe with a concave bottom shape includes an inner sole, an outer sole attached to the inner sole and having a front section and a back section, and a middle sole embedded between the inner sole and the outer sole at the front section of the outer sole. The middle sole is concave in shape. The edge of the middle sole is spaced from the edge of the outer sole by a substantially uniform and predetermined distance at the front section of the outer sole. The outer sole conforms to the concave shape of the middle sole. The concave shape allows the outer sole to hook on a rocky ledge. The middle sole provides a structure that causes the concave outer sole to substantially maintain the concave shape when pressure is applied to the outer sole.

A molded stiffener forms the middle sole. The middle sole forms apertures. The apertures reduce the amount of material used in manufacturing the middle sole and reduce the weight of the middle sole. The middle sole is slightly stiff to maintain the concave shape, yet also has some flexibility to absorb the forces applied to the shoe.

The outer sole has about a uniform thickness. The uniform thickness of the outer sole maintains and emulates the concave shape of the middle sole. The outer sole forms the shoe bottom surface, which is also concave due to the concave shape of the molded middle sole. The substantially uniform thickness of the outer sole results in the bottom surface conforming to the concave shape of the middle sole. The concave shape of the bottom surface of the outer sole provides increased hooking ability on the rocks for the climber.

The edges of the outer sole need to be thin enough to feel the foothold. Thin edges on the outer sole provides stability, in contrast to the thick edges of the prior art walking shoes that ire prone to slipping on the rocks. A concaved shoe bottom provides added edging power for standing on small footholds, because the edges will grab the foothold and will not move around to cause a slip from the foothold. Thin flat uniformed thickness outer soles are used to provide better sensitivity.

The climbing shoe with a concave sole is further described with detail in the appended figures, description and claims.

DETAILED DESCRIPTION OF THE DRAWINGS

Figure 1:
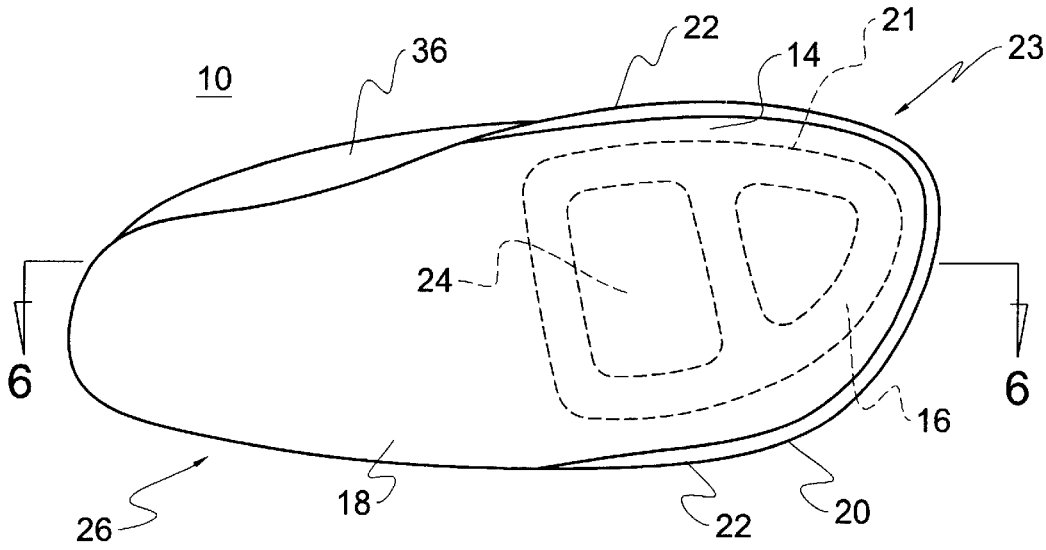
FIG. 1 is a bottom view of the climbing shoe with the molded middle sole in dashed lines.
Figure 2:
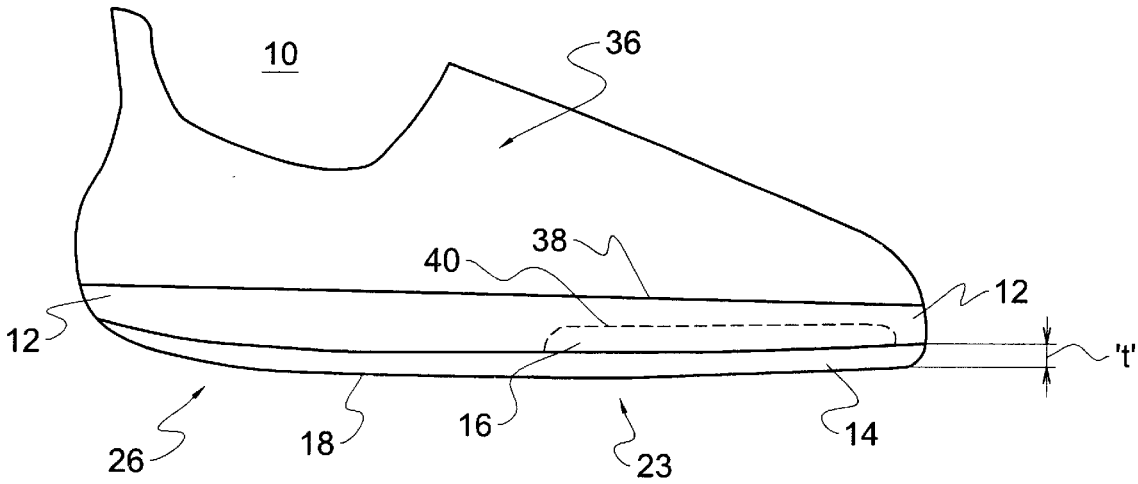
FIG. 2 is a side view of the climbing shoe with the molded middle sole in dashed lines.
Figure 3:
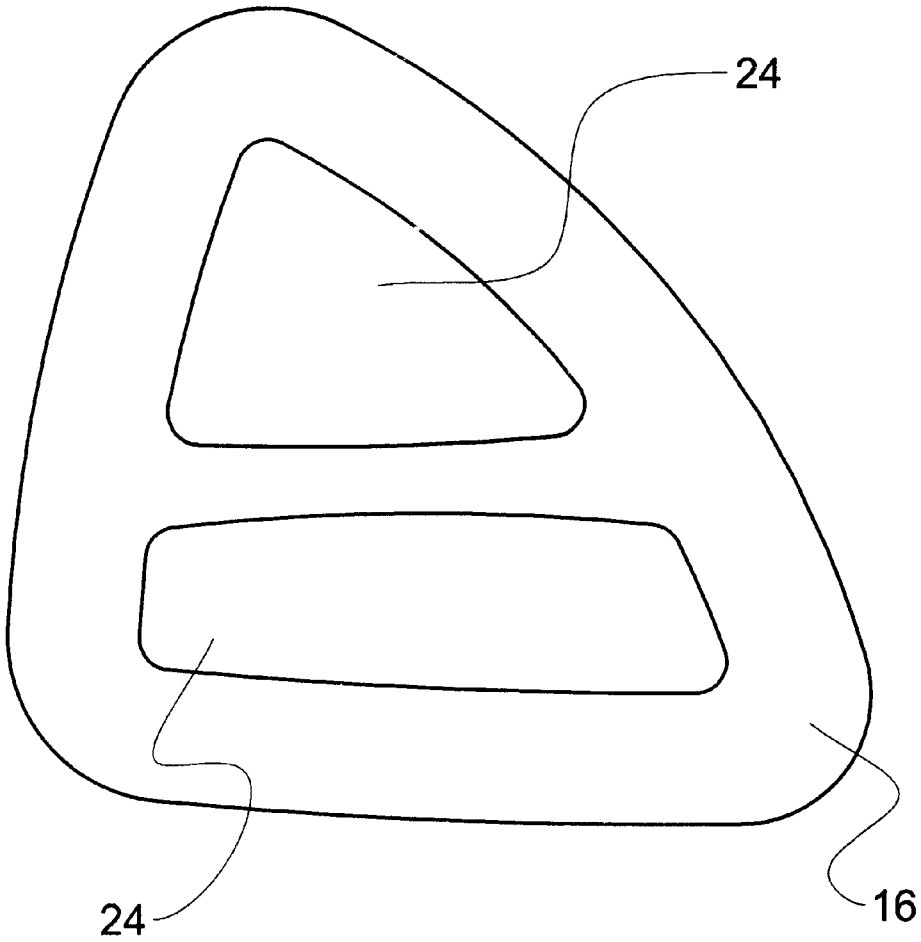
FIG. 3 is a bottom view of the molded middle sole.
Figure 4:
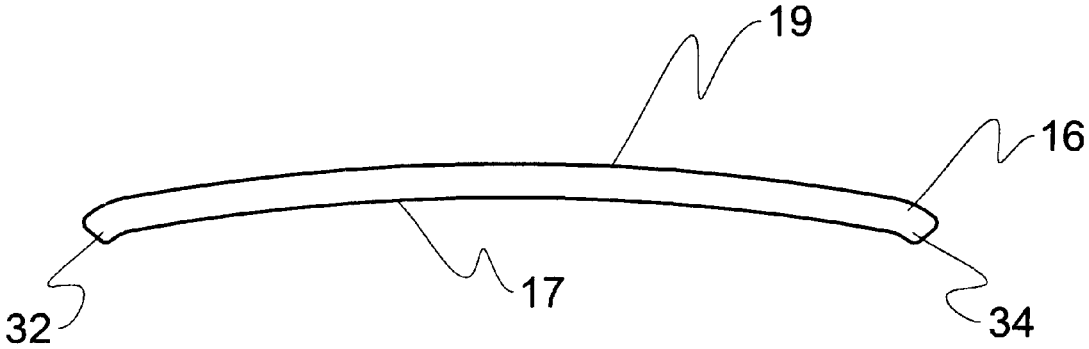
FIG. 4 is an end view of the molded middle sole as shown is FIG. 3.
Figure 5:
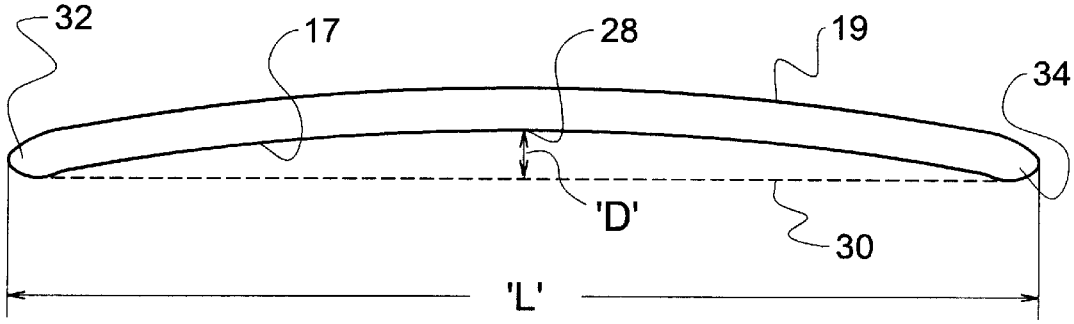
FIG. 5 is an end view of the molded middle sole showing the distance 'D' and length 'L'.
Figure 6:
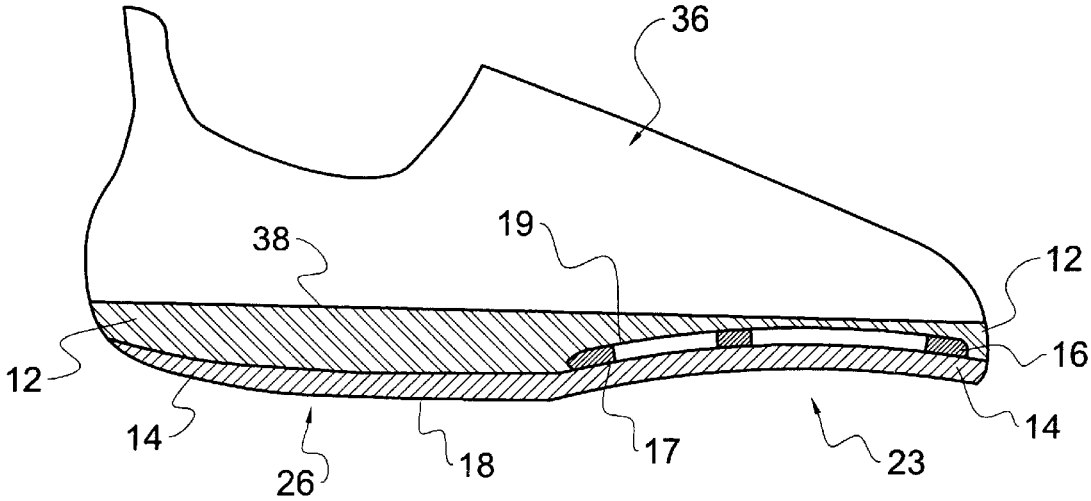
FIG. 6 is a cutaway view taken along the 6—6 line of FIG. 1.

Referring to FIG. 1 through FIG. 6, a climbing shoe 10 includes an inner sole 12, an outer sole 14 attached to the inner sole 12 and having a front section 23 and a back section 26, and a middle sole 16 embedded between the inner sole 12 and the outer sole 14 at the front section 23 of the outer sole 14. The front section 23 supports the ball of a foot of a person who wears the shoe 10, and the back section 26 supports the heel of the foot. As shown in FIGS. 1 and 6, the edge 21 of the middle sole 16 is spaced from the edge 20 of the outer sole 14 by a predetermined and substantially uniform distance, in the front section 23 of the outer sole 14. The inner sole 12 and the outer sole 14 directly contact with each other at the portion outside the embedded middle sole 16. As shown in FIGS. 4 and 6, the middle sole 16 is concave in shape having a concave bottom surface 17. The concave bottom surface 17 of the middle sole 16 is attached to the outer sole 14. The middle sole has a convex top surface 19 that is attached to the inner sole 12. The middle sole 16 has a stiffness that maintains the concave shape, along with flexibility that absorbs the pressure and movements of the foot without fracturing the middle sole 16. The outer sole 14 conforms to the concave shape of the middle sole 16. The concave shape allows the outer sole 14 to hook on a rocky ledge. The molded middle sole 16 maintains a substantially concave shape when a climber applies pressure to the climbing shoe 10 during scaling of the rock formations. The molded middle sole 16 provides a structure that causes the flat outer sole 14 to substantially maintain the concave shape when pressure is applied to the outer sole 14.

The outer sole 14 has about a uniform thickness 't', as shown in FIG. 2. The uniform thickness 't' of the flat outer sole 14 maintains and emulates the concave shape of the middle sole 16. The outer sole 14 has a shoe bottom surface 18, which is concave at the front section 23 of the outer sole 14 due to the concave shape of the molded middle sole 16. The substantially uniform thickness 't' of the outer sole 14 results in the bottom surface 18 conforming to the concave share of the middle sole 16. The outer sole 14 can vary slightly in thickness 't', particularly around the outer edges 20 of the bottom surface 18, so that a slight rim 22 can be formed on the outer edges 20 at the front section 23 of the outer sole 14. When included, the rim 22 provides greater gripping and hooking capability on rocks and crevices when climbing.

Referring to FIG. 2 and FIG. 5, the inner sole has an upper surface 38. The upper surface 38 is flat. As shown in FIG. 2, the middle sole has a top surface 40 that is flat. The flat upper surface 38 provides a comfortable surface for the bottom of the foot. If the upper surface 38 is a convex shape, then the climbing shoe 10 can be uncomfortable. When the middle sole has a flat top surface 40 as shown in FIG. 2, then the inner sole 12 can be a substantially uniform thickness on the area that the inner sole 12 contact the middle sole 16, with a flat upper surface 38. When the middle sole has the convex top surface 19 as shown in FIGS. 4–6, then the inner sole 12 needs to be thinner near the apex 28 to create a flat upper surface 38.

Referring particularly to FIG. 1 and FIG. 3, the middle sole 16 forms apertures 24. The apertures 24 reduce the amount of material used in manufacturing the middle sole 16 and reduce the weight of the middle sole 16. Manufacturing costs are lower when less material is used. The middle sole 16 is molded from a material that provides sufficient strength even with the apertures 24 scattered throughout the middle sole 16 structure. Common materials that are applicable include fiberglass, rigid plastic, epoxy compositions, rubber polymers, steel or other metals.

A molded material forms the concave shape of the molded middle sole 16. FIG. 4 hows the concave shape of the middle sole 16 when it is viewed from the heel side of the climbing shoe 10. The middle sole 16 can be sized to just cover the front 23 section of the climbing shoe 10. Although not shown, a larger sized middle sole 16 can be used to cover substantially all of the outer sole 14, including the front section 23 and the back section 26.

Referring particularly to FIG. 5, the middle sole 16 has a an apex 28, a base line 30 having a length 'L', a first end 32, a second end 34, and a distance 'D'. The base line 30 travels from the first end 32 to the second end 34. The distance 'D' is the vertical distance between the base line 30 and he apex 28. The apex 28 and distance 'D' are located here the distance between the concave surface 17 and the base line 30 is the greatest. The distance 'D' is less than twenty percent of the length 'L'. In one embodiment the distance 'D' is about ten percent of the length 'L'. The top surface 19 is convex.

Referring to FIG. 6, a cutaway view along the 6—6 line of FIG. 1 is shown. The upper surface 38 of the inner sole 12 is flat. The inner sole 12 is thin near the convex top surface 19 of the middle sole 16 to create a flat upper surface 38. The middle sole 16 has the concave bottom surface 17. Attached to the inner sole 12 is the upper portion 36 of the shoe that covers and supports the foot. The inner sole 12 and the outer sole 14 can be primarily made from rubber polymer. The upper portion 36 can include any material commonly used for shoes, such as leather, nylon and cotton fabric.

Figure 7:
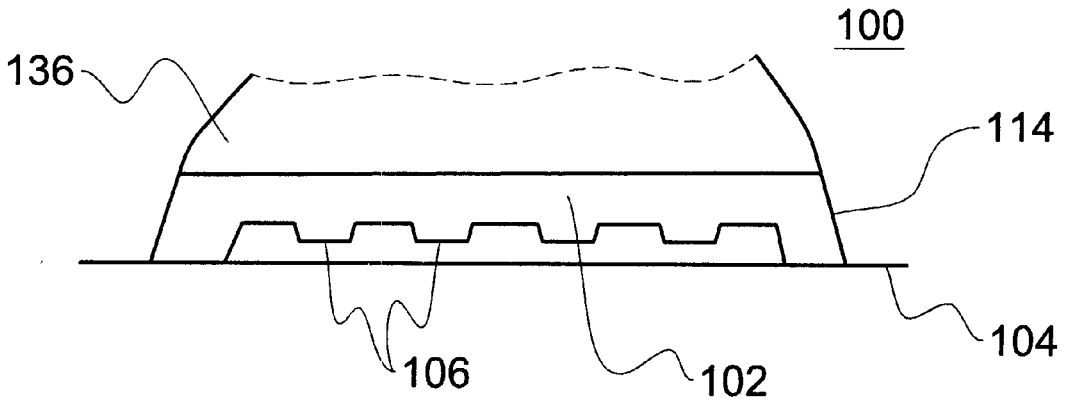
FIG. 7 PRIOR ART
FIG. 7 is a front view of a prior art walking shoe, with the inside area separate from the ground.
Figure 8:
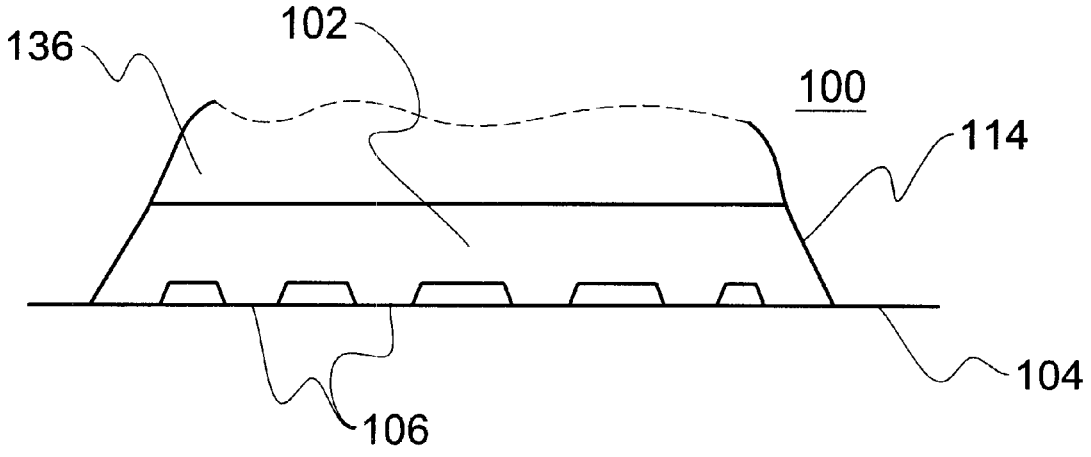
FIG. 8 PRIOR ART
FIG. 8 is a front view of a prior art walking shoe, showing the inside area gripping the ground.

Referring to FIGS. 7 and 8, a prior art walking shoe 100 is illustrated. The upper portion 136 is shown cutoff. In FIG. 7, the inside area 102 and studs 106 of the outer sole 114 do not touch the ground 104. FIG. 8 shows the walking shoe 100 pressed down on the ground 104, the outer sole 114 changes shape to grip the ground 104 contours and on soft ground the studs 106 penetrate the soil. As the weight is taken off the outer sole 114, it releases energy, giving wearers an added spring to their step. The changing shape of the outer sole 114 is advantageous for walking, but can be detrimental in rock climbing. An outer sole 114 that flexed and changed shape would be susceptible to losing a grip on a rocky ledge.

The concave shape of the bottom surface 18 of the outer sole 14 of the climbing shoe 10 provides improved gripping ability for the climber. Climbing shoes with flat bottom surfaces 18 do not have any contours in shape that will help to grip the rocks. The climbing shoe 10 with a concave sole provides an added gripping ability, besides just the pressure of the climbing shoe 10 applied downward on the rocks. The concave shape can improve the confidence, climbing ability and safety of the climber.

Although the present invention has been described in considerable detail with regard to the preferred versions thereof, other versions are possible. Therefore, the appended claims should not be limited to the descriptions of the preferred versions contained herein.

What is claimed is:

1. A climbing sloe comprising:

a) an upper portion;

b) an inner sole attached to the upper portion;

c) an outer sole attached to the inner sole and having a front section and a back section; and d) a middle sole embedded between the inner sole and the outer sole at the front section of the outer sole;

wherein the middle sole having a concave surface, wherein an edge of the middle sole is spaced from an edge of the outer sole by a predetermined and substantially uniform distance at the front section of the outer sole, wherein the concave surface of the middle sole is attached to the front section of the outer sole, wherein the front section conforms to the concave shape of the middle sole, wherein the middle sole has stiffness to maintain the concave shape when a climber applies pressure to the climbing shoe during rock climbing, whereby the front section can hook on a rocky ledge, and whereby the front section of the outer sole substantially maintains the concave shape when pressure is applied to the outer sole.

2. The climbing shoe of claim 1 wherein the outer sole has a rim formed on the edge of the outer sole at the front section of the outer sole.

3. The climbing shoe of claim 1 wherein the front section of the outer sole has about a uniform thickness.

4. The climbing shoe of claim 3 wherein the back section of the outer sole is flat.

5. The climbing shoe of claim 4 wherein the middle sole further having a convex surface, wherein the convex surface is attached to the inner sole.

6. The climbing shoe of claim 5 wherein the middle sole forms apertures, thereby reducing the weight of the middle sole.

7. The climbing shoe of claim 6 wherein the inner sole further having an upper surface, wherein the upper surface is flat.

8. The climbing shoe of claim 7 wherein the outer sole further having a bottom surface, wherein the front section of the bottom surface substantially conforms to the concave shape of the middle sole.

9. The climbing shoe of claim 3 wherein the middle sole further having a top surface, wherein the top surface is flat.

10. The climbing shoe of claim 9 wherein the middle sole further having an apex, and a base line, and wherein the vertical distance between the base line and the apex is less than about 20 percent of the length of the base line.

11. The climbing shoe of claim 10 wherein the middle sole forms apertures, thereby reducing the weight of the middle sole.

12. The climbing shoe of claim 11 wherein the back section of the outer sole is flat.

13. The climbing shoe of claim 10 wherein the vertical distance between the base line and the apex is less than about 10 percent of the length of the base line.

* * * * *